US010436507B2

(12) United States Patent
Igra

(10) Patent No.: US 10,436,507 B2
(45) Date of Patent: Oct. 8, 2019

(54) PROCESS AND APPARATUS FOR PRODUCING PRESSURIZED GASEOUS NITROGEN BY CRYOGENIC SEPARATION OF AIR

(71) Applicant: LINDE AKTIENGESELLSCHAFT, Munich (DE)

(72) Inventor: Robert Michael Igra, Odiham (GB)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/398,766

(22) Filed: Jan. 5, 2017

(65) Prior Publication Data

US 2017/0211879 A1 Jul. 27, 2017

(30) Foreign Application Priority Data

Jan. 21, 2016 (EP) ..... 16000148

(51) Int. Cl.
*F25J 3/04* (2006.01)
*F25J 3/02* (2006.01)

(52) U.S. Cl.
CPC ..... *F25J 3/0443* (2013.01); *F25J 3/0257* (2013.01); *F25J 3/04018* (2013.01); *F25J 3/0429* (2013.01); *F25J 3/04163* (2013.01); *F25J 3/04187* (2013.01); *F25J 3/04254* (2013.01); *F25J 3/04303* (2013.01); *F25J 3/04412* (2013.01); *F25J 3/04496* (2013.01); *F25J 3/04884* (2013.01); *F25J 2200/04* (2013.01);

(Continued)

(58) Field of Classification Search
CPC .... F25J 3/04018; F25J 3/0443; F25J 3/04406; F25J 3/04412
See application file for complete search history.

(56) References Cited

U.S. PATENT DOCUMENTS 5,123,249 A * 6/1992 Buttle ..... F25J 3/042 62/646
5,711,167 A * 1/1998 Ha ..... F25J 3/04048 62/652

(Continued)

FOREIGN PATENT DOCUMENTS

DE 10339224 A1 3/2005

*Primary Examiner* — Brian M King
(74) *Attorney, Agent, or Firm* — Millen White Zelano & Branigan, PC

(57) ABSTRACT

Process and apparatus for producing pressurized gaseous nitrogen by cryogenic separation of air. The distillation column system includes a high pressure column, a medium pressure column, a main condenser and top condenser both being condenser-evaporators. Compressed and purified feed air is cooled in a heat exchanger and introduced to the distillation system. A gaseous nitrogen stream from the high pressure column is condensed in the main condenser. Bottom liquid of the medium pressure column is evaporated and gaseous nitrogen from the medium pressure column is condensed in the top condenser. Liquid nitrogen from the medium pressure column is pressurized and introduced to the high pressure column. A second gaseous nitrogen stream from the high pressure column is recovered as pressurized gaseous nitrogen product. A portion of the compressed and purified feed air is work-expanded and then warmed in the main heat exchanger.

21 Claims, 1 Drawing Sheet

(52) U.S. Cl.
CPC ..... *F25J 2200/54* (2013.01); *F25J 2200/72* (2013.01); *F25J 2205/84* (2013.01); *F25J 2210/06* (2013.01); *F25J 2210/42* (2013.01); *F25J 2215/42* (2013.01); *F25J 2235/42* (2013.01); *F25J 2240/10* (2013.01); *F25J 2245/40* (2013.01); *F25J 2245/42* (2013.01)

(56) References Cited

U.S. PATENT DOCUMENTS

| | | | | |
|---|---|---|---|---|
| 5,934,104 | A * | 8/1999 | Fidkowski | F25J 3/04224 62/643 |
| 6,568,207 | B1 | 5/2003 | Brugerolle | |
| 2004/0244417 | A1* | 12/2004 | Alamorian | F25J 3/04048 62/645 |
| 2012/0131951 | A1* | 5/2012 | Myobatake | F25J 3/04024 62/615 |
| 2014/0260422 | A1* | 9/2014 | Brugerolle | F25J 3/04054 62/643 |

* cited by examiner

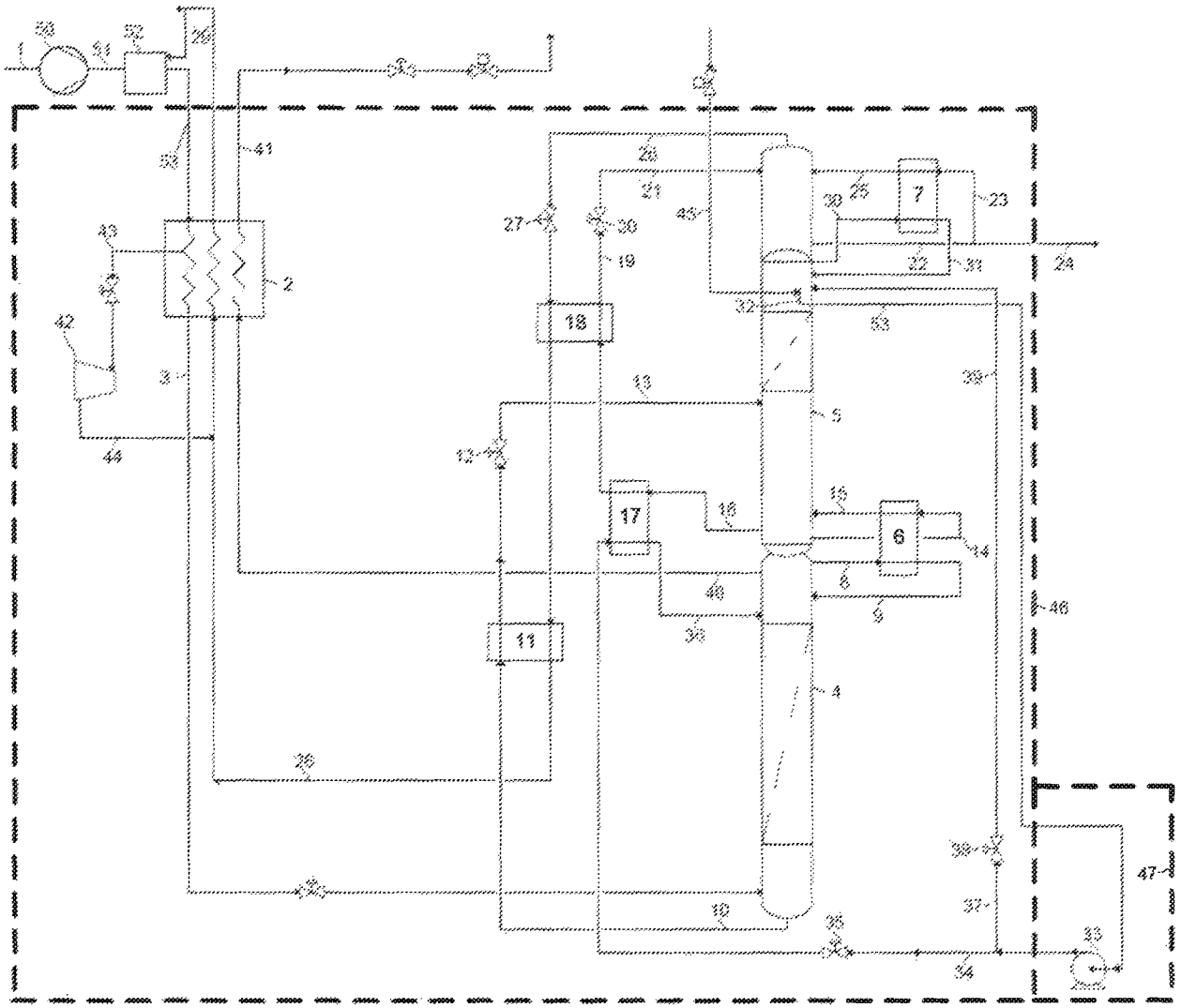

PROCESS AND APPARATUS FOR PRODUCING PRESSURIZED GASEOUS NITROGEN BY CRYOGENIC SEPARATION OF AIR

The invention regards a process for producing pressurized gaseous nitrogen by cryogenic separation of air. It further concerns an apparatus for producing pressurized gaseous nitrogen by cryogenic separation of air.

"Condenser-evaporator" means a heat exchanger, in which a first, condensing fluid stream is brought into indirect heat exchange with a second, evaporating fluid stream. Each condenser-evaporator comprises a liquefaction space and an evaporation space which, respectively, consist of liquefaction passages and evaporation passages. In the liquefaction space, the condensation (liquefaction) of the first fluid stream is performed; in the evaporation space the evaporation of the second fluid stream is conducted. Evaporation and liquefaction spaces are formed by groups of passages, which are in heat transfer relationship. The evaporation space of a condenser-evaporator can be realized as a bath evaporator, a falling film evaporator or a forced-flow evaporator.

The above kind of process and an apparatus are known from U.S. Pat. No. 6,868,207 [P16C012-EPR3, L'AL2003]. The refrigeration is provided either by liquid assist or by a turbine exhausting into the medium pressure column or by both. The first variant consumes cold and thereby energy from the outside, the second variant does not, but incorporates operational problems.

The problem to be solved by the invention is to minimize influences of the cold production on the distillation, thereby ensuring a particularly smooth and flexible operation of the system as a whole.

Such problem is solved by the features of the invention. By this special turbine configuration expanding a portion of the feed air from about high pressure column pressure to normally somewhat above atmospheric pressure, turbine expansion is completely decoupled from distillation, as no fluid from the distillation is sent to turbine. There is also no additional compressor needed to produce the cold.

The work-expanded air can be, e.g., sent to the medium pressure column, in particular to its bottom, or by-passed around the distillation, e.g. by a separate main heat exchanger passage warming the work-expanded air to a temperature up to that of the warm end of the main heat exchanger and rejecting it to the atmosphere.

In a preferred embodiment of the invention, however, the work-expanded turbine stream is mixed with a waste stream upstream of the main heat exchanger, such waste stream being taken from the vapor produced in the evaporation space of the medium pressure column top condenser. As a consequence, also no fluid to the distillation goes through the turbine, i.e., there is a full decoupling of refrigeration production and distillation. Simultaneously, the main heat exchanger configuration is nearly as simple and compact as in the liquid assist variant, as there is no separate group of passages needed for the work-expanded air; just an intermediate withdrawal for the turbine air must be provided.

A portion of the refrigeration requirements can be provided by liquid assist, i.e., by introducing a cryogenic liquid from an external source and/or by using a cryogenic liquid that has been internally produced at another point of time into the distillation column system. In the first alternative, the cryogenic liquid comes from another air separation or nitrogen liquefaction plant, or from a tank filled by such other plant. In the second alternative, at least a portion of the cryogenic liquid is produced by the process itself, e.g. during periods of low energy cost and/or low product demand, and re-introduced into to the plant during periods of higher energy cost and/or higher product demand. By this method, there can be, e.g., a constant production of gaseous nitrogen with varying energy consumption.

The cryogenic liquid is preferably liquid nitrogen, but any other mixture or pure fraction of liquefied air gases may be used as well. In principle, the plant may also be operated by liquid assist only, i.e. without a turbine.

The introduction of the liquid is performed at one or more of the following places:

- the medium pressure column,
- the high pressure column,
- the pressurized liquid nitrogen line upstream or downstream the pressurising step,
- the evaporation space of the medium pressure column top condenser,
- the evaporation space of the main condenser.

Preferably, no gaseous nitrogen from the top of the medium pressure column is fed to the main heat exchanger and recovered as product. Even more preferably, the complete gaseous nitrogen produced at the top the medium pressure column is condensed in the liquefaction space of the medium pressure column top condenser and then pumped to at least high pressure column pressure and finally withdrawn as pressurized gaseous nitrogen under at least high pressure column pressure. Thereby, all the nitrogen produced is naturally recovered under the higher distillation pressure. The high pressure column gaseous nitrogen can of course be further compressed in one or more nitrogen compressors.

It is advantageous, if the compressed and purified feed air stream that is introduced into the main heat exchanger under the first pressure comprises the total feed air for the distillation column system. As a consequence, only a single group of passages for cooling air in the main heat exchanger and only a single air compressor is required.

Preferably, the expansion machine that expands the turbine stream is the single expansion machine in the process. There is no other cold production in the system except, optionally, liquid assist, i.e., introducing liquid produced at other places or at different times into the distillation system. This makes the respective plant compact and cheap.

The operating pressure at the top of the high pressure column is preferably chosen in the invention to be between 7.4 and 9.2 bars, in particular between 7.6 and 8.5 bars.

Preferably, the second pressure the turbine stream is expanded to, is lower than 1.6 bar, and lies in particular in the range of 1.2 to 1.4 bar.

In general, in the invention, the preferred ranges of the operating pressures of the columns at their tops are:

- high pressure column 4: 7.4 bar to 9.2 bar, in particular 7.6 bar to 8.5 bar
- medium pressure column 5: 3.7 bar to 4.6 bar, in particular 3.9 bar to 4.3 bar.

Moreover, the invention regards an apparatus for producing pressurized gaseous nitrogen. The apparatus according the invention may be supplemented by apparatus features described herein.

The invention is further described on the basis of an embodiment shown in the drawing.

The total feed air 1 is compressed in a main air compressor 50 to a first pressure of e.g. 8.2 bars. The compressed air stream 51 is purified in a molecular sieve station 52, The compressed and purified air 53 is introduced at the first pressure to a main heat exchanger 2 at its warm end. A first portion of the air (non-turbine air) 3 is cooled to the cold end of the main heat exchanger 2 and introduced into a high pressure column 4. The high pressure column 4 is operated at a pressure of e.g. 7.9 bar at the top. It is a part of a distillation column system which further comprises a medium pressure column 5, a main condenser 6 and a medium pressure column top condenser 7. Both condensers 6, 7 are constructed as condenser-evaporators.

A first gaseous nitrogen stream from the top the high pressure column is totally condensed in the liquefaction space of the main condenser 6. The liquid nitrogen 9 produced in the main condenser 6 is introduced into the top of the high pressure column 4 as reflux. Bottom liquid of the high pressure column (crude liquid oxygen) 10 is cooled in a first subcooler 11 and expanded to medium pressure column pressure in a valve 12. The expanded crude oxygen 13 is sent to an intermediate section of the medium pressure column 5.

A first stream 14 of oxygen-enriched bottom liquid of the medium pressure column 5 is sent to the evaporation space of the main condenser 6 and at least partially evaporated. The evaporated first stream 15 is fed back to the medium pressure column bottom and serves as rising vapour inside the medium pressure column 5.

A second stream 16 of oxygen-enriched bottom liquid of the medium pressure column 5 is cooled in a second subcooler 17 and in a third subcooler 18. Controlled by valve 20, the subcooled liquid 19, 21, 22, 23 is sent to the evaporation space of the medium pressure column top condenser 7. A small portion may be withdrawn as purge stream 24. Controlled by valve 27, the vapour 25, 26 from the evaporation space of the medium pressure column top condenser 7 is sent as waste gas to subcoolers 18, 11. The prewarmed waste gas 28 is fully warmed in the main heat exchanger 2. The warm waste gas 29 is vented and/or used in the molecular sieve station as regenerating gas.

Gaseous nitrogen 30 from the top the medium pressure column 5 is condensed in the liquefaction space of the medium pressure column top condenser 7. Liquid nitrogen 31 produced thereby is fed back to a cup 32 in the top of the medium pressure column 4. A first portion of such liquid nitrogen is used as reflux in the medium pressure column 5. A second portion 53 of such liquid nitrogen is withdrawn from the medium pressure column 4, pressurized in a pump 33 to a pressure which is at least equal, preferably higher than the high pressure column pressure. At least a first portion 34, 36 of the pressurized liquid nitrogen flows through pump pressure control valve 35 and subcooler 17 into the high pressure column 4. If necessary, a second portion 37 of the pumped liquid nitrogen may flow through re-circulation path 38, 39 back to the medium pressure column 5.

A second gaseous nitrogen stream 40 from the top the high pressure column 4 is warmed in the main heat exchanger 2. The warmed second gaseous nitrogen stream 41 is recovered as pressurized gaseous nitrogen product.

In the embodiment, the primary source of refrigeration is an air turbine 42. The compressed and purified feed air stream 1 is split at an intermediate temperature of the main heat exchanger 2 into a turbine stream 43 and the non-turbine stream 3. The turbine stream is work-expanded in the air turbine 42 from the first pressure to a second pressure. The work-expanded turbine stream 44 is mixed with the waste stream 28 upstream the main heat exchanger 2. The mixed stream is warmed in main heat exchanger 2. The air turbine can be braked by any known brake mechanism, preferably by an oil brake, an air brake, oil bearing, gas bearing or foil bearing. Preferably no booster compressor is coupled to the air turbine.

As additional source of refrigeration by "liquid assist", a cryogenic liquid 45 from an external source, e.g., liquid nitrogen can be introduced into the medium pressure column 5 (as shown in the drawing) or into the high pressure column 4 (not shown). The plant as shown can be operated differently at different points of time: air turbine running, no liquid assist air turbine running combined with liquid assist air turbine not running-liquid assist only.

In a particular embodiment of the invention, in a first operating mode, a portion of the pumped liquid nitrogen 34, 37 is recovered under pressure and stored in a pressurized liquid nitrogen tank (not shown in the drawing). In a second operating mode, the air turbine is shut off or operated with reduced throughput, and the stored liquid is taken for liquid assist (line 45).

Coming back to the drawing, the dashed line around the large rectangle indicates the outer wall of a first cold box 46 surrounding all cryogenic parts except the nitrogen pump 33. The space between the apparatus and the outer wall is filled with pulverised insulation material like perlite. There is a separate cold box section 47 enclosing the nitrogen pump 33 only.

In another plant, the air turbine is omitted and the plant is steadily run with liquid assist as the single source of refrigeration.

In yet another plant, the nitrogen pump is omitted and a gaseous nitrogen stream from the top of the medium pressure column is warmed in the main heat exchanger and withdrawn as gaseous pressurized product. It can separately warmed from the high pressure column gaseous nitrogen product, so that two pressurized gaseous nitrogen products are recovered under different pressures, or the high pressure column gaseous nitrogen product is expanded to medium pressure column pressure and then mixed with the medium pressure column gaseous nitrogen product.

In yet another plant, the turbine expansion 42 is replaced by another type of cold production like a cryocooler, piston or sterling etc.

The invention claimed is:

1. A process for producing pressurized gaseous nitrogen by cryogenic separation of air in a distillation column system comprising a high pressure column, a medium pressure column, a main condenser which is a condenser-evaporator having a liquefaction space and an evaporation space, and a medium pressure column top condenser which is a condenser-evaporator having liquefaction space and an evaporation space, compressing the total feed air in a main air compressor to a pressure which is higher than the operating pressure at the top of the high pressure column, purifying the compressed air stream, introducing the compressed and purified feed air stream into a main heat exchanger under a first pressure and cooling said compressed and purified feed air stream in said main heat exchanger, condensing a first gaseous nitrogen stream removed from the top of the high pressure column in a liquefaction space of the main condenser, removing bottom liquid from the high pressure column and introducing said bottom liquid of the high pressure column into an intermediate section of the medium pressure column, removing bottom liquid from the medium pressure column and introducing said bottom liquid of the medium pressure column into an evaporation space of the medium pressure column top condenser, removing gaseous nitrogen from the top of the medium pressure column and condensing the gaseous nitrogen in the liquefaction space of the medium pressure column top condenser, removing liquid nitrogen from the medium pressure column or from the liquefaction space of the medium pressure column top condenser and pressurizing the liquid nitrogen to a pressure which is at least equal to the high pressure column pressure to form pressurized liquid nitrogen, introducing at least a portion of the pressurized liquid nitrogen into the high pressure column, removing a second gaseous nitrogen stream from the top the high pressure column and warming the second gaseous nitrogen stream in the main heat exchanger, and recovering the warmed second gaseous nitrogen stream as the pressurized gaseous nitrogen product, and splitting the compressed and purified feed air stream into a turbine stream and a non-turbine stream, cooling the non-turbine stream in the main heat exchanger, introducing the non-turbine stream into the distillation column system, and work-expanding the turbine stream in an expansion machine, wherein the compressed and purified feed air stream is split at an intermediate temperature of the main heat exchanger into said turbine stream and said non-turbine stream, the turbine stream is work-expanded in the expansion machine from the first pressure to a second pressure to form a work-expanded turbine stream, and the work-expanded turbine stream is warmed in the main heat exchanger.

2. The process according to claim 1, wherein a waste stream taken from vapor produced in the evaporation space of the medium pressure column top condenser is warmed in the main heat exchanger and the work-expanded turbine stream is mixed with the waste stream upstream the main heat exchanger.

3. The process according to claim 1, wherein a cryogenic liquid from an external source is introduced into the distillation column system.

4. The process according to claim 3, wherein the cryogenic liquid is introduced into the distillation column system at one or more of the following places:

the medium pressure column, the high pressure column, the pressurized liquid nitrogen line upstream or downstream of the pressurization of the liquid nitrogen, the evaporation space of the medium pressure column top condenser, and/or the evaporation space of the main condenser.

5. The process according to claim 1, wherein no gaseous nitrogen from the top of the medium pressure column is fed to the main heat exchanger and recovered as product.

6. The process according to claim 1, wherein all of the gaseous nitrogen produced at the top the medium pressure column is condensed in the liquefaction space of the medium pressure column top condenser.

7. The process according to claim 1, wherein the total feed air introduced into the distillation column system is obtained from the compressed and purified feed air stream that is introduced into the main heat exchanger under the first pressure.

8. The process according to claim 1, wherein the expansion machine used to expand the turbine stream is the single expansion machine used in the process.

9. The process according to claim 1, wherein the operating pressure at the top of the high pressure column is between 7.4 and 9.2 bars.

10. The process according to claim 1, wherein the second pressure that the turbine stream is expanded to is lower than 1.6 bar.

11. An apparatus for producing pressurized gaseous nitrogen by cryogenic separation of air comprising:

a distillation column system comprising a high pressure column, a medium pressure column, a main condenser which is a condenser-evaporator having liquefaction space and an evaporation space, and a medium pressure column top condenser which is a condenser-evaporator having liquefaction space and an evaporation space, a main air compressor for compressing the total feed air to a first pressure which is higher than the operating pressure at the top of the high pressure column, a purification stage for purifying the compressed air stream, an air conduit for introducing the compressed and purified feed air stream into a main heat exchanger under a first pressure for cooling, a line for introducing at least a portion of the cooled air from the main heat exchanger into the distillation column system, a line for introducing a first gaseous nitrogen stream from the top the high pressure column into liquefaction space of the main condenser, a line for introducing bottom liquid from the high pressure column to an intermediate section of the medium pressure column, a line for introducing bottom liquid from the medium pressure column into the evaporation space of the medium pressure column top condenser, a line for introducing gaseous nitrogen from the top the medium pressure column into the liquefaction space of the medium pressure column top condenser, a pump for pressurizing liquid nitrogen from the medium pressure column or from the liquefaction space of the medium pressure column top condenser to a pressure which is at least equal to the high pressure column pressure, a line for introducing at least a portion of pressurized liquid nitrogen into the high pressure column, a line for introducing a second gaseous nitrogen stream from the top the high pressure column into the main heat exchanger, a line for recovering the second gaseous nitrogen stream, after warming in the main heat exchanger, as the pressurized gaseous nitrogen product, piping for splitting the compressed and purified feed air stream into a turbine stream and a non-turbine stream, means within the main heat exchanger for cooling the non-turbine stream and for a line for introducing the non-turbine stream from the main heat exchanger into the distillation column system, and an expansion machine for work-expanding the turbine stream, wherein the piping for splitting the compressed and purified feed air stream into a turbine stream and a non-turbine stream is located at an intermediate temperature of the main heat exchanger, wherein the expansion machine is formed and connected for work-expanding the turbine stream from the first pressure to a second pressure, and further comprising means within the main heat exchanger for warming the work-expanded turbine stream.

12. The apparatus according to claim 11, wherein said expansion machine is the single expansion machine.

13. The apparatus according to claim 11, wherein an outlet of the expansion machine is connected with a waste gas line coming from the evaporation space of the medium pressure column top condenser.

14. The process according to claim 1, wherein the operating pressure at the top of the high pressure column is between 7.6 and 8.5 bars.

15. The process according to claim 1, wherein the second pressure that the turbine stream is expanded to is in the range of 1.2 to 1.4 bar.

16. The process according to claim 1, wherein the operating pressure at the top of the medium pressure column is in the range of 3.7 bar to 4.6 bar.

17. The process according to claim 1, wherein the operating pressure at the top of the medium pressure column is in the range of 3.9 bar to 4.3 bar.

18. The process according to claim 1, wherein, after being cooled in the main heat exchanger, said non-turbine stream is introduced into said high pressure column of said distillation column system.

19. The process according to claim 1, wherein said expansion machine is a turbine.

20. The process according to claim 1, wherein a cryogenic liquid produced by the process is introduced into the distillation column system.

21. The process according to claim 20, wherein the cryogenic liquid is introduced into the distillation column system at one or more of the following places:

the medium pressure column, the high pressure column, the pressurized liquid nitrogen line upstream or downstream of the pressurization of the liquid nitrogen, the evaporation space of the medium pressure column top condenser, and/or the evaporation space of the main condenser.

* * * * *